United States Patent [19]

Weisz

[11] 4,453,478

[45] Jun. 12, 1984

[54] PUSHBUTTON CONTROL FOR SEWING MACHINE

[75] Inventor: William Weisz, Tenafly, N.J.

[73] Assignee: The Singer Company, Stamford, Conn.

[21] Appl. No.: 487,424

[22] Filed: Apr. 21, 1983

[51] Int. Cl.[3] ..... D05B 3/02

[52] U.S. Cl. ..... 112/158 A; 112/158 B; 112/158 D

[58] Field of Search ..... 112/158 A, 158 D, 158 B, 112/158 C, 158 E; 200/340

[56] References Cited

U.S. PATENT DOCUMENTS 3,254,618 6/1966 Eguchi ..... 112/158 C 4,256,047 3/1981 Suzuki et al. ..... 112/158 F X

*Primary Examiner*—Peter P. Nerbun

*Attorney, Agent, or Firm*—William V. Ebs; Robert E. Smith; Edward L. Bell

[57] ABSTRACT

Pushbuttons for controlling pattern sewing in a sewing machine are provided with latch plates which prevent the simultaneous retention in actuated positions of pushbuttons for selecting bight controlled patterns and pushbuttons for selecting combined bight and feed controlled patterns, and which are disposable to permit the retention in actuated positions of pushbuttons in either one or the other of said groups.

8 Claims, 8 Drawing Figures

PUSHBUTTON CONTROL FOR SEWING MACHINE

BACKGROUND OF THE INVENTION

1. Field of the Invention

The invention relates to pushbutton controls for use in selecting patterns to be sewn on a sewing machine.

2. Description of the Prior Art

It is well known to provide a sewing machine with pushbuttons which can be selectively operated to cause particular bight patterns to be sewn on the machine. A machine with such a pushbutton control may also include a feed controlling cam which an operator can render effective to alter the patterns selectable with the pushbuttons, and so increase the number of different patterns producible by the machine. However, some bight patterns, which it is desireable to have available for selection on a machine of the kind described, become unsuitable for use when influenced by the feed control cam.

It is a prime object of the invention to provide for the alternative selection with a pushbutton control on a sewing machine of bight controlled patterns or bight plus feed controlled patterns, and to prevent the selection of unusable patterns with multiple pushbuttons.

It is another object of the present invention to provide for the selection on a sewing machine of bight controlled patterns with one group of pushbuttons, and the selection of bight plus feed controlled patterns with another group of pushbuttons in a manner preventing pushbuttons in both groups thereof from being disposed in actuated positions at the same time.

It is another object of the invention to provide a pushbutton control for a sewing machine with latching means preventing pushbuttons in each of two groups thereof from being disposed in actuated positions at the same time, but permitting a plurality of pushbuttons in either one of the two groups to be simultaneously located in actuated positions.

Other objects and advantages of the invention will become apparent during a reading of the specification taken in connection with the accompanying drawings.

SUMMARY OF THE INVENTION

A pushbutton control for a sewing machine is provided with latch means for two groups of pushbuttons, one group of which is for use in selecting bight controlled patterns, and the other group of which is for use in selecting bight plus feed controlled patterns. A control member which is operable to initiate or discontinue cam controlled feeding controls latch means in a manner preventing the pushbuttons for selecting bight controlled patterns from being retained in actuated positions while cam controlled feeding is in effect, and preventing the pushbuttons for selecting bight plus feed controlled patterns from being retained in actuated positions in the absence of cam controlled feeding.

DESCRIPTION OF THE PREFERRED EMBODIMENT

Figure 1:
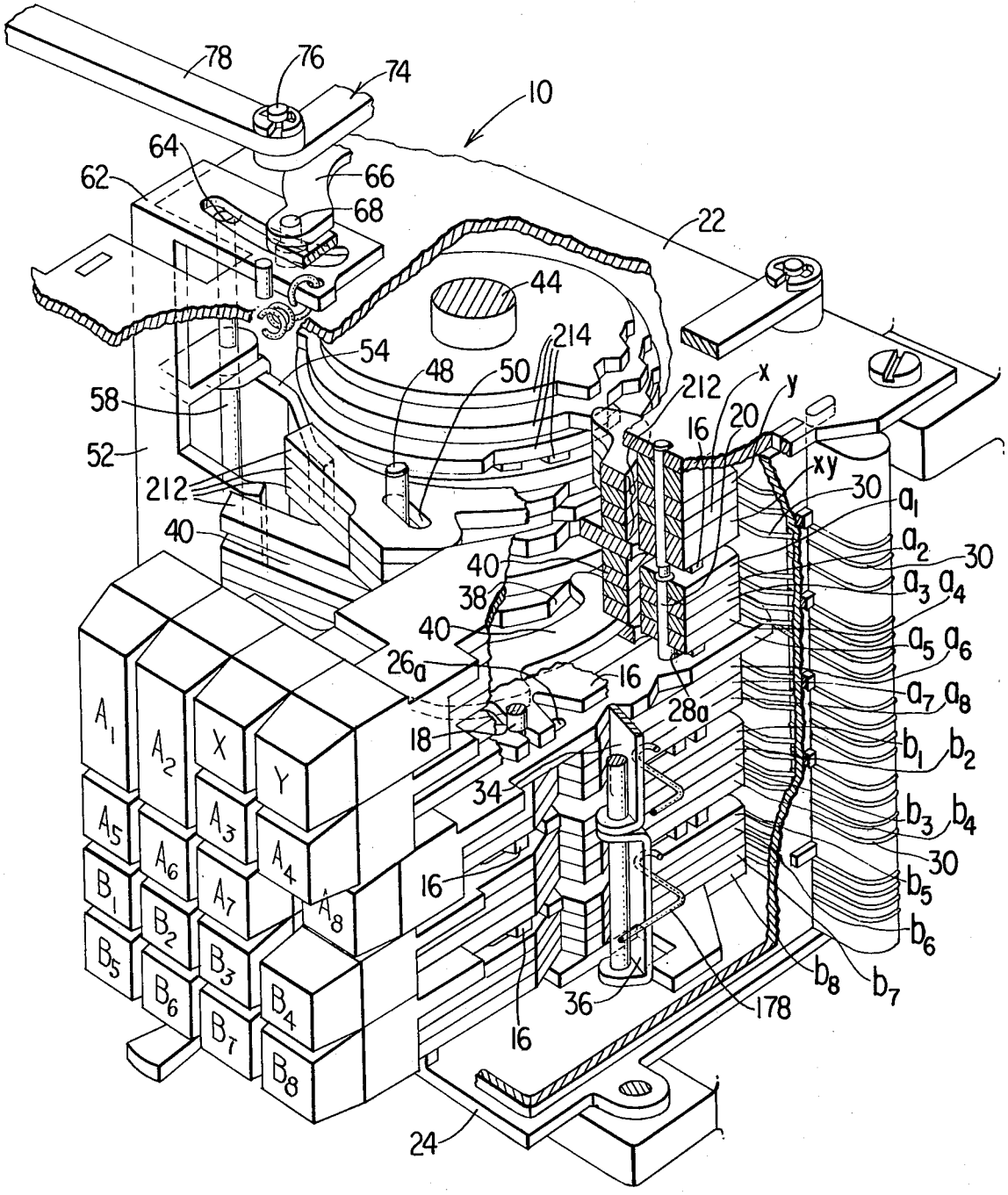
FIG. 1 is a perspective view of a control module according to the invention with portions broken away to show internal parts.

Referring to FIG. 1 of the drawings, reference character 10 designates a sewing machine pushbutton control module which is generally of the kind shown in the copending patent application of William Weisz for "Pushbutton Control Module for a Sewing Machine", Ser. No. 449,721, filed Dec. 14, 1982. The module includes A pushbuttons ($A_1$ through $A_8$) and B pushbuttons ($B_1$ through $B_8$). Pushbuttons $A_1$ through $A_8$ are formed with extensions $a_1$ through $a_8$ respectively, and pushbuttons $B_1$ through $B_8$ are formed with extensions $b_1$ through $b_8$ respectively. The pushbutton extensions project rearwardly and terminate in a vertical column. The pushbutton extensions are vertically stacked between separating plates 16 for relative sliding motion and are movable between actuated and unactuated positions on pins 18 and 20 extending between end plates 22 and 24, and passing through elongate slots $\mathbf{26}_a$, $\mathbf{28}_a$ in extensions $a_1$ through $a_8$, and like slots $\mathbf{26}_b$, $\mathbf{28}_b$ in extensions $b_1$ through $b_8$. The pushbuttons are biased in one direction toward unactuated positions by the springs 30 of a spring assembly 32, and are movable in the opposite direction by an operator. The module is provided with pushbutton latch means according to the invention including a latch plate 34 for pushbuttons $A_1$ through $A_8$, and a latch plate 36 for pushbuttons $B_1$ through $B_8$. Plate 34 also serves as a latch for module buttons X and Y. The operation of the latch means is explained hereinafter.

Each of pushbutton extensions $a_1$ through $a_8$, and $b_1$ through $b_8$ is associated in a common plane with a cam 38 and a cam follower 40. The cams are part of a cylindrical member 42 which is suitably affixed on a shaft 44 that is rotatably mounted in bearing (not shown) located in plates 22 and 24. Shaft 44 projects above plate 22 to receive a gear 46. The cam followers are mounted on a pin 48 extending between and fixed in plates 22 and 24. Pin 48 passes through elongate holes 50 in the cam followers. Adjacent cam followers mutually engage on top and bottom surfaces between the plates and are slidable across one another on the engaging surfaces.

A needle plate 52 and a feed wobble plate 54 are mounted for pivotal motion about a common axis defined by a shaft 58 fixed in plates 22 and 24. The needle plate 52 extends through a slot 60 in plate 22 and terminates in a bracket 62 just above the surface of plate 22. Bracket 62 includes an arcuate slot 64 having a radius corresponding to the effective length of a bracket connecting link 66, and having one end positionable directly over the pivotal axis of needle plate 52. Link 66 carries a pin 68 at one end, and a pin 70 at the other end. Pin 68 extends into slot 64 and pin 70 pivotally connects link 66 to one arm 72 of a needle bight controlling bell crank 74. The other end of the bell crank pivotally connects at 76 with a needle bight controlling link 78.

The bell crank is pivotally movable on a pin 80 mounted in plate 22.

A linkage system including links 82, 84 and 86 is provided for positioning pin 68 in slot 64. Link 82 is pivotally connected at one end to pin 68 and at the other end to a pin 88 in one end of link 84. The opposite end of link 84 is pivotally mounted in plate 22 at 90. Link 84 includes a slot 92 in which a pin 94 extending from a tab 96 at an intermediate location on the link 86 is received. One end of link 86 is pivoted at 98 in plate 22, whereas the opposite end is free and can be moved by an operator to position pin 68 in slot 64. A coil spring 100 having one end 102 anchored in plate 22 and the other end connected at 104 to bracket 62 biases the bracket toward a limiting position defined by a stop 106.

A stitch length control bracket 108 is pivotally mounted on a shaft 110 which is affixed in the wings 112 and 114 of a member 116 that is affixed with screws 118 and 120 on plate 24. A tension spring 122 shown between wing 114 on member 116, and a stitch length controlling arm 124 on bracket 108 biases the bracket in a direction causing a projecting edge 126 on the bracket to engage a cam 128 which is part of a plate 130. Arm 134 connects with feed regulating mechanism (not shown) of the kind disclosed, for example, in U.S. Pat. No. 3,527,183 for "Work Feeding Mechanism for Sewing Machine" of Jan Szostak, issued Sept. 8, 1970.

Plate 130 is pivotally mounted in module end plate 24 on a pin 132, and is movable by a lever 134. The plate is held in sliding engagement with plate 24 by a resilient metal strap 136 which is located under the head 138 of pin 132 at a key slot 140 in one end of the strap, and is affixed at the other end with a screw 142 to plate 24. Plate 130 includes a slot 146 for a pin 148 that is affixed at 149 in one corner of a triangular plate 150. Slot 146 includes two functional segments 152 and 154 which are concentric about the pivotal axis of plate 130, and are interconnected by a non-concentric segment 153. A widened concentric segment 155 is provided only to facilitate the positioning of plate 130 at the bottom of the module during assembly. Pin 148 is positionable in one or the other of the functional segments by the operation of lever 134. As shown, plate 150 is formed with a slot 156 in a second corner, and is affixed at 158 in a third corner to a shaft 160 which supports plates 34 and 36 for pivotal movement thereon. A pin 162 affixed at 163 on a slidable member 164 extends through a slot 166 in plate 24 and projects into slot 156 in plate 150. Member 164 is slidable on the pins 18 and 20 extending through elongate holes 168 and 170 in the member.

Figure 3:
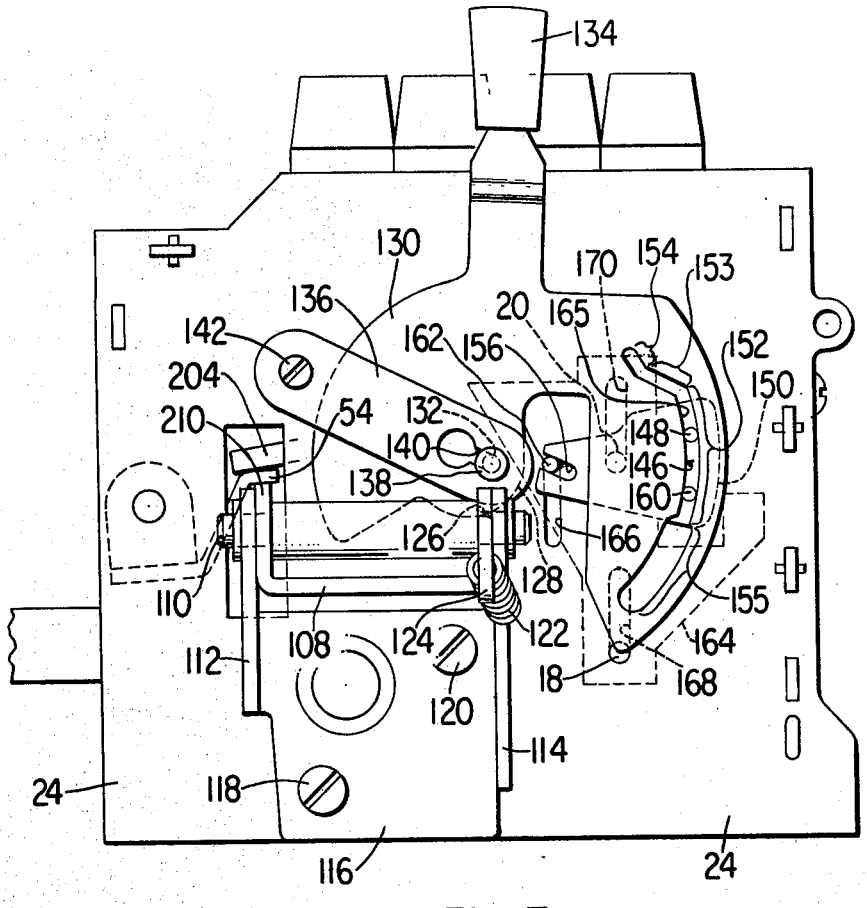
FIG. 3 is a bottom view of the module.
Figure 4:
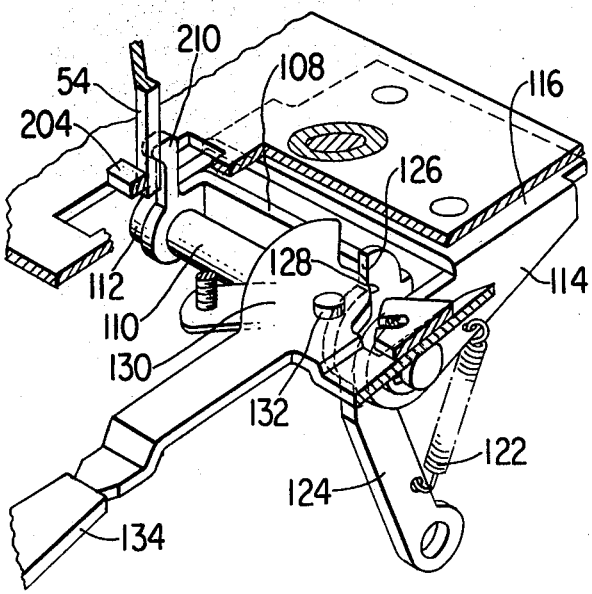
FIG. 4 is a fragmentary perspective view showing stitch controlling mechanism at the bottom of the module.
Figure 7:
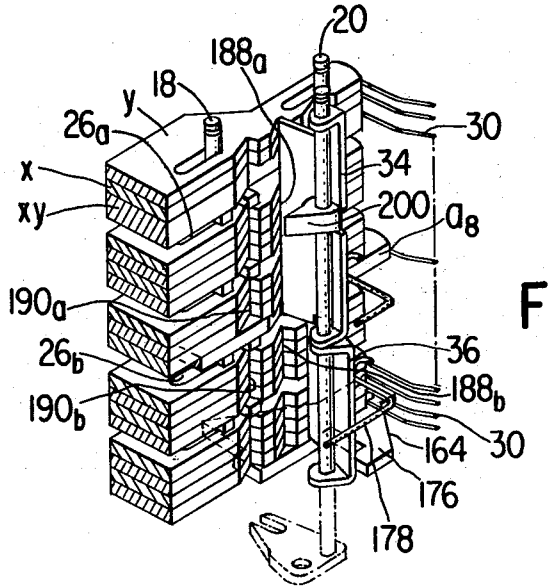
Figure 6:
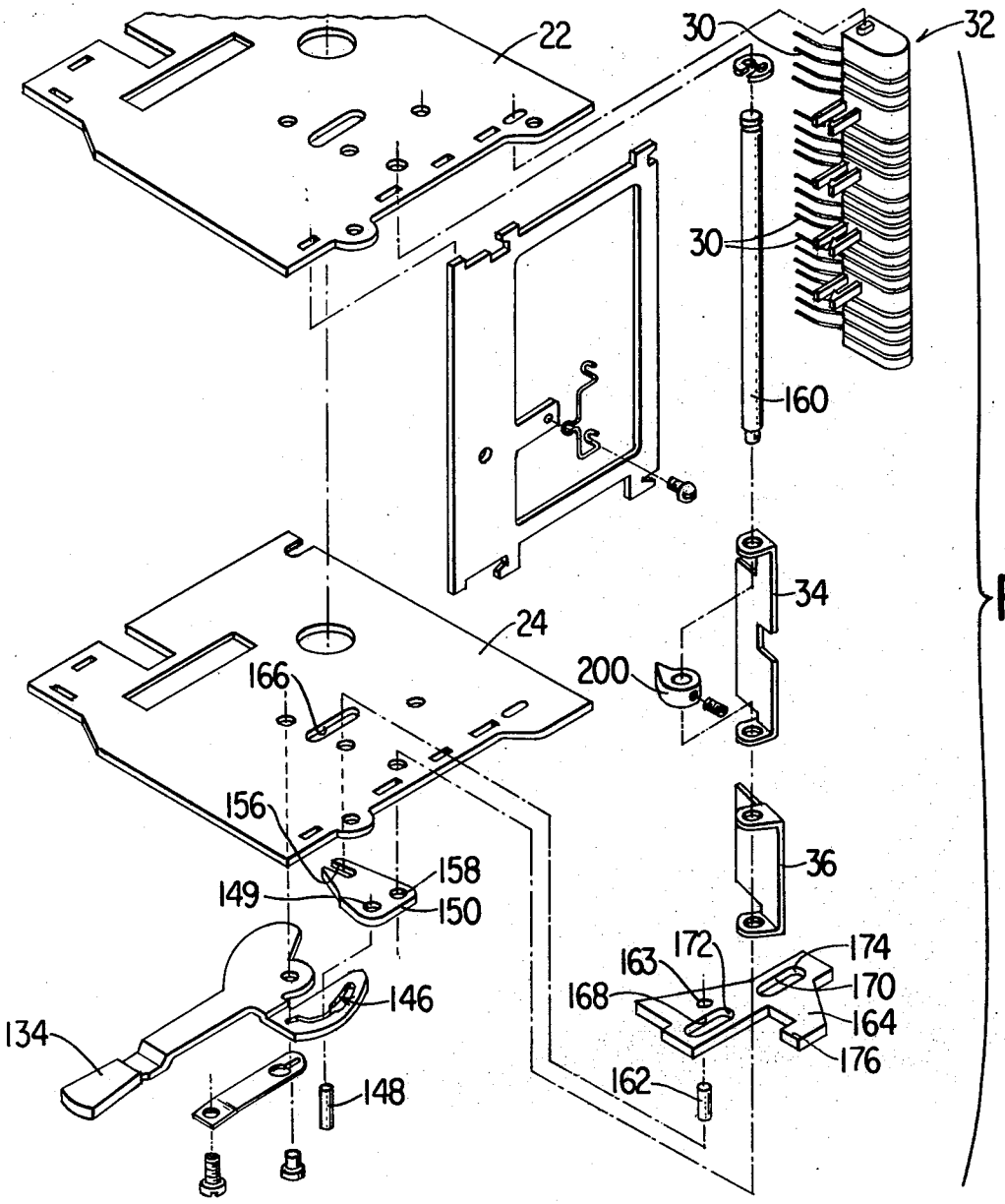
FIG. 6 is an exploded perspective view showing parts of the module.

Assuming pin 148 has been disposed as in FIG. 3, in segment 152 of slot 146 by the positioning of lever 134, member 164 is in a position in which pins 18 and 20 are engaged by the member at the ends 172 and 174 of elongate holes 168 and 170, and latch plate 36 is held by an arm 176 of member 164 against the opposition of a latch plate spring 178 in a position preventing engagement of the latch plate 36 with any of the extensions $b_1$ through $b_8$ of the B pushbuttons. With latch plate 36 so disposed, the B pushbuttons, $B_1$ through $B_8$, are maintained by springs 30 in unactuated positions in which pins 18 and 20 are engaged by extensions $b_1$ through $b_8$ at the right hand ends of elongate holes $26_b$ and $28_b$ (FIG. 7) and any B pushbutton which is pushed by an operator is immediately returned to its unactuated position by its associated spring 30. While latch 36 is held away from the B pushbutton extensions, the other latch plate 34 is held by spring 178 against the extensions on pushbuttons $A_1$ through $A_{12}$. Springs 30 bias the A pushbuttons toward unactuated positions where pins 18 and 20 are engaged by extensions $a_1$ through $a_8$ at the right hand end of elongate holes $26_a$ and $28_a$, and plate 34 extends into notches $188_a$ of the extensions. However, whenever the A pushbuttons are depressed, individually or simultaneously in combination, plate 34 is caused to enter notches $190_a$ in the extensions of the depressed pushbuttons and the depressed pushbuttons are retained in actuated positions by the plate. All such depressed pushbuttons are released and returned to unactuated positions when a new pushbutton in the $A_1$ to $A_8$ group is depressed. In FIG. 7, extension $a_8$ has been moved to a latched position by the depression of pushbutton $A_8$.

When an A pushbutton such as $A_8$ is pushed from an unactuated into an actuated position, its coplanar cam follower 40 is caused to ride up along edge 192 of the pushbutton extension and assume an activated position of enforced engagement at one end 194 with the associated cam 38 and at the opposite end 196 with needle plate 52. As cam shaft 44 rotates the engaged cam during operation of the machine, the follower is rocked in a manner determined by the profile of the cam about the pushbutton extension serving as a supporting fulcrum. The follower positions and imparts pivotal movement to needle plate 52, and the needle plate acting through bracket 62, pin 68, link 66, crank 74 and link 78 controls the side to side movement of a needle bar (not shown). The needle bight obtainable with any particular cam rendered effective by any one of the A pushbuttons, can be selectively determined by the positioning of pin 68 in slot 64 with link 86 as described in the copending patent application with Ser. No. 449,721, mentioned hereinbefore. Movement of the pin 68 away from the pivotal axis of needle plate 52 at the one end of the slot increases the amplitude of movement of pin 52 to increase bight, whereas movement toward the needle plate axis decreases the amplitude of movement of pin 52 to decrease bight.

Lever 134 can be moved without affecting the latch plate positions while pin 148 is in segment 152 of slot 146 because segment 152 extends along a circular arc having its center on the pivotal axis of plate 130. Lever 134 is therefor, then available to manually control stitch length. As previously noted, plate 130 has a cam 128 formed thereon. Such cam 128 permits an operator to selectively position bracket 108 with lever 138 and so regulate the operation of stitch length regulating mechanism connected to bracket arm 124.

Figure 8:
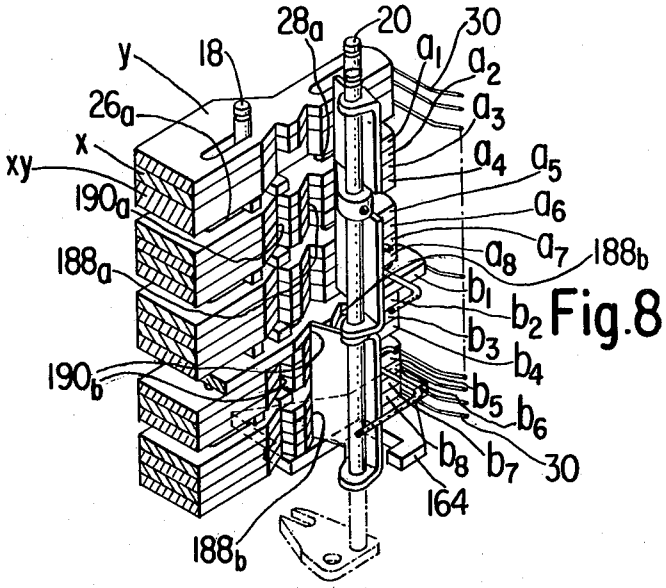
FIGS. 7 and 8 are fragmentary perspective views showing portions of the module in different control positions.

The described positions for latch plates 34 and 36 are reversed when an operator moves lever 134 to position pin 148 in segment 154 of slot 146 in plate 130 and so effect a repositioning of plate 150. Plate 150 acting through pin 162 causes member 164 to be moved into a position apart from latch 36, and the latch is caused by spring 178 to engage the extensions on pushbuttons $B_1$ through $B_8$. At the same time, shaft 160 which is pivotally mounted in module end plates 22 and 24 is turned by plate 150, and a fixed pawl 200 on the shaft is caused to move latch plate 34 into a position away from the extensions on pushbuttons $A_1$ through $A_{12}$. Consequently, the B pushbuttons become retainable in actuated positions with the latch plate 36 extending into the notches $190b$ of depressed buttons, whereas the A pushbuttons become retainable only in unactuated positions wherein pins 18 and 20 are at the right hand ends of slots $26_a$ and $28_a$ (FIG. 8). Any latched pushbuttons $B_1$ through $B_{12}$ are released to an unactuated position with pins 18 and 20 in the right hand end of elongate holes 26$_b$ and 28$_b$, and plate 34 in notches 188$_b$ of the extensions $b_1$ through $b_8$, when another of the B pushbuttons is depressed. In FIG. 8, extension $b_1$ has been moved to a latched position by the depression of pushbutton $B_1$.

Figure 2:
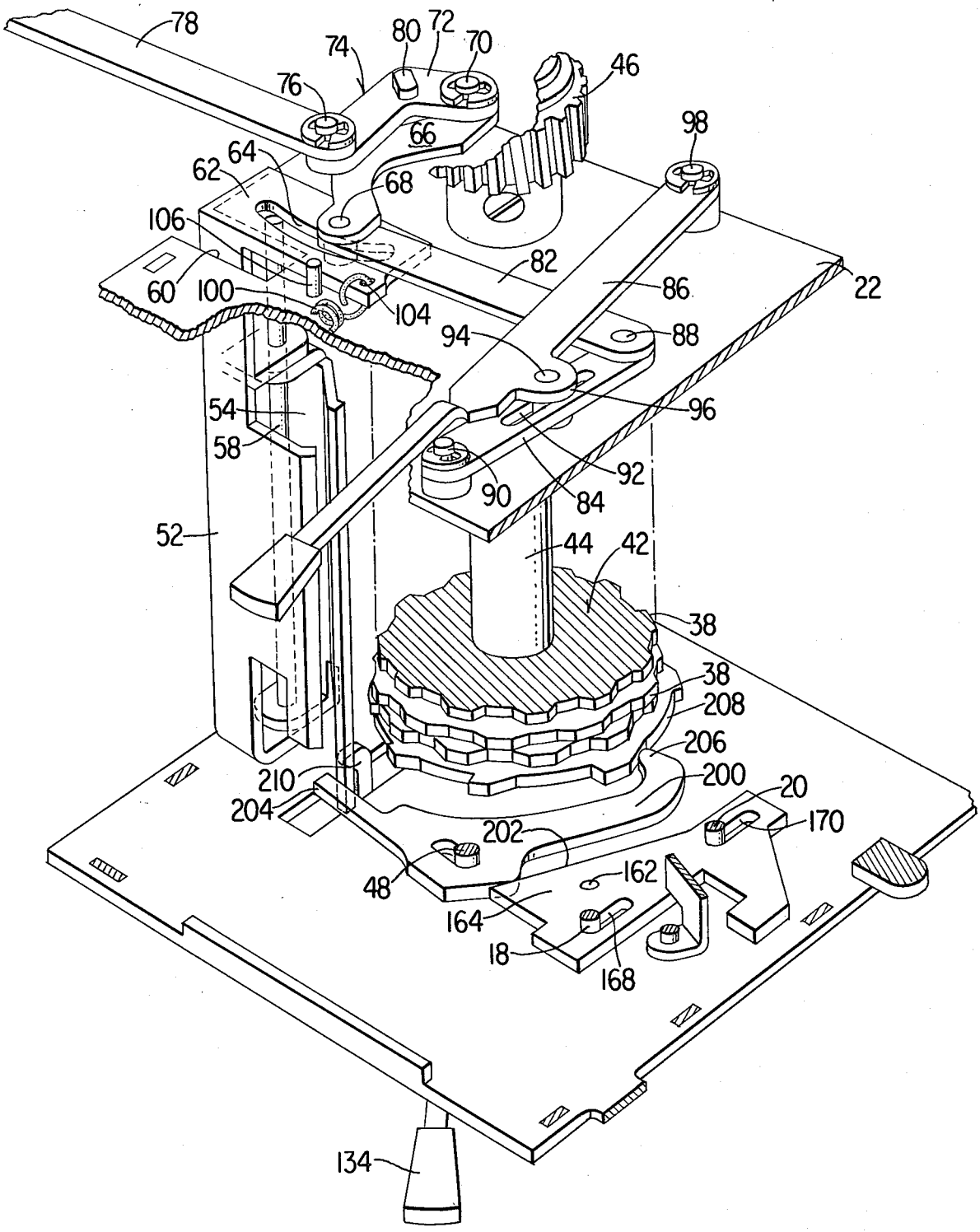
FIG. 2 is another perspective view of the module with portions broken away to show additional parts of the device.
Figure 5:
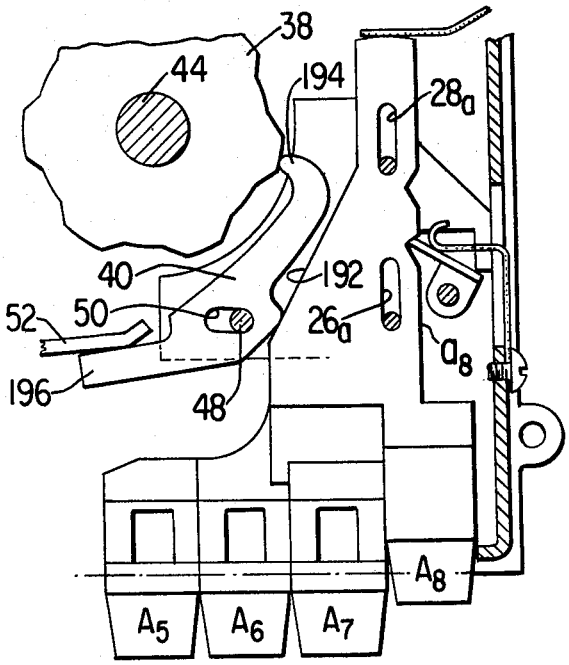
FIG. 5 is a view taken horizontally through the module between adjacent rows of pushbuttons.

The movement away from latch 36 of member 164 results in an associated coplanar cam follower 200 being disposed in a supported position on edge 202 of the member with opposite ends 204 and 206 of the cam follower in engagement with feed wobble plate 54 and a feed controlling cam 208 rotatable by shaft 44 (FIG. 2). As cam 208 is rotated by shaft 44, follower 200 is actuated by the cam. The follower actuates wobble plate 54, and the wobble plate acting against a finger 210 on bracket 108 actuates the feed regulating mechanism connected to the bracket arm 124, all according to the profile of cam 208. When a B pushbutton is pushed from an unactuated into an actuated position, its coplanar cam follower 40 is moved into a supported position on an inclined edge of the pushbutton extension with opposite ends of the cam follower in engagement with an associated cam 38 and needle plate 52 as in the manner shown for A pushbuttons in FIG. 5. The follower is rocked by the cam as shaft 44 rotates, and pivotal movement is imparted to needle plate 52. As previously noted, the needle plate acting through bracket 62, pin 68, link 66, crank 74 and link 78 controls the positioning and side to side movement of a needle bar. Consequently, the machine is enabled to sew combined bight and feed controlled patterns as selectively determined with the B pushbuttons. The bight width of any such patterns can be selected as previously described by the positioning of pin 68 in slot 64 with link 86.

Pushbuttons X and Y are controlled by latch plate 34 in the same manner as the A pushbuttons. The X and Y pushbuttons are therefor retainable in actuated positions only when the B pushbuttons cannot be so retained. The X and Y pushbuttons include integral extensions x and y, and are further associated with a floating extension xy as described in the U.S. patent application, Ser. No. 449,721, mentioned hereinbefore. Such pushbuttons operably connect through the extensions X, Y and XY, cam followers 212, and cams 214 with the needle plate 52 and feed wobble plate 54 as set forth in the said application, and may be used selectively to control the formation of buttonholes in the manner described in the application.

It is to be understood that the present disclosure relates to a preferred embodiment of the invention which is for purposes of illustration only, and is not to be construed as a limitation of the invention. Numerous alterations and modifications will suggest themselves to those skilled in the art, and all such modifications which do not depart from the spirit and scope of the invention are intended to be included within the scope of the appended claims.

I claim:

1. In combination, selectively operable pushbuttons having actuated and unactuated positions, mechanism for causing predetermined patterns to be sewn on a sewing machine in actuated positions of selectively operated pushbuttons belonging to a particular group thereof, other mechanism for causing other predetermined patterns to be sewn on the machine in actuated positions of selectively operated pushbuttons in a group other than said particular group, pushbutton latch means, and means for disposing the latch means in either of alternate positions, in one of which only pushbuttons in said particular group are retainable by the latch means in actuated positions, and in the other of which only pushbuttons in the other group are retainable by the latch means in actuated positions.

2. In combination, selectively operable pushbuttons having actuated and unactuated positions, bight controlling mechanism for causing predetermined patterns to be sewn on a sewing machine in actuated positions of selectively operated pushbuttons belonging to a particular group thereof, other bight controlling mechanism and feed controlling mechanism for jointly causing other predetermined patterns to be sewn on the machine in actuated positions of selectively operated pushbuttons in a group other than said particular group, pushbutton latch means, and latch positioning means including a control member which is disposable in either of alternate positions, in one of which only pushbuttons in said particular group are retainable by the latch means in actuated positions, and in the other of which only pushbuttons in the other group are retainable by the latch means in actuated positions.

3. The combination of claim 2 including means for deactivating and for activating the feed controlling means in the said one and other position respectively of the control member.

4. The combination of claim 2 wherein the latch means includes a first and second latch plate which are engageable only at different times with the buttons of said particular group and other group respectively according to the position of said control member.

5. The combination of claim 4 wherein the latch plates are pivotally movable about a common axis.

6. The combination of claim 2 including means operable by the latch positioning means for controlling stitch length while the pushbuttons in said particular group are retainable in actuated positions.

7. The combination of claim 2 wherein the pushbuttons are notched in extensions thereof for engagement with the latch means in actuated and unactuated positions of the said pushbuttons.

8. The combination of claim 2 including a buttonhole controlling pushbutton having an actuated and an unactuated position, buttonhole controlling mechanism for causing a buttonhole to be sewn on the machine in an actuated position of the buttonhole controlling pushbutton, said buttonhole controlling pushbutton being retainable in the actuated position only when the latch positioning control member is in the said one position.

* * * * *